US005626062A

United States Patent [19]

Colvin

[11] Patent Number: 5,626,062

[45] Date of Patent: May 6, 1997

[54] SOCKET AND RATCHET WRENCH

[76] Inventor: David S. Colvin, 3786 Ranya, Union Lake, Mich. 48387

[21] Appl. No.: 213,383

[22] Filed: Mar. 15, 1994

Related U.S. Application Data

[63] Continuation-in-part of Ser. No. 57,426, May 4, 1993, abandoned, which is a continuation of Ser. No. 822,178, Jan. 16, 1992, abandoned.

[51] Int. Cl.[6] ..... B25B 13/46

[52] U.S. Cl. ..... 81/63.2; 81/177.85

[58] Field of Search ..... 81/60–63.2, 121.1, 81/124.3, 124.7, 177.85

[56] References Cited

U.S. PATENT DOCUMENTS

| | | | |
|---|---|---|---|
| 838,109 | 12/1906 | Hanes et al. . | |
| 845,717 | 2/1907 | Miller . | |
| 1,447,564 | 3/1923 | Norlund et al. . | |
| 2,869,410 | 1/1959 | Prichard | 81/63 X |
| 3,532,012 | 10/1970 | Pryor . | |
| 3,877,328 | 4/1975 | Sullivan . | |
| 4,328,720 | 5/1982 | Shiel | 81/63 |
| 4,475,420 | 10/1984 | Atkinson et al. | 81/63 X |
| 4,515,044 | 5/1985 | Harstan | 81/61 |
| 4,520,697 | 6/1985 | Moetelli . | |
| 4,602,534 | 7/1986 | Moetelli . | |
| 4,817,475 | 4/1989 | Kelly et al. . | |

*Primary Examiner*—James G. Smith
*Attorney, Agent, or Firm*—Brooks & Kushman P.C.

[57] ABSTRACT

A socket and ratchet wrench combination (20) disclosed has a socket (22) and a ratchet wrench (24) that are detachably connectible to each other through a retainer (58) preferably embodied by a split ring (68) to provide nut driving even when a threaded shank of a relatively long length extends outwardly from the nut being torqued.

9 Claims, 4 Drawing Sheets

SOCKET AND RATCHET WRENCH

This is a continuation-in-part of prior application Ser. No. 08/057,426 filed on May 4, 1993 now abandoned as a continuation of prior application Ser. No. 07/822,178 which was filed on Jan. 16, 1992 and is now abandoned.

TECHNICAL FIELD

This invention relates to a socket and to a ratchet wrench as well as to the combination of the socket and ratchet wrench which have particular utility when used with each other.

BACKGROUND ART

Most conventional sockets have a driving end including engagement surfaces that engage a nut or bolt head to be torqued and also have a driven end with a square drive opening that receives a square drive tang of an associated wrench to provide the torquing. With this conventional construction, the socket must have a relatively long axial length in order to be capable of engaging a nut through which a threaded shank of a bolt or stud extends. Otherwise, the threaded shank will engage the interior of the socket and/or the wrench drive tang and thereby prevent engagement of the driven end of the socket with the nut for torquing. As such, it is conventional for complete socket sets to include both "shallow sockets" and "deep sockets". The shallow sockets can torque bolt heads or nuts which do not have a relatively long projecting threaded shank, and during the torquing permit the manual application of the torque to the wrench at a relatively close axial location to the engagement of the driving end of the socket with the bolt head or nut. On the other hand, deep sockets are capable of accommodating nuts with relatively long threaded shanks projecting therethrough even though the manual torque applied to the wrench is located at a more remote axial location from the location of engagement between the driving end of the socket and the nut.

Prior art references noted during an investigation conducted in connection with the present invention are discussed below.

U.S. Pat. No. 838,109 Hanes et al discloses a socket having an internal opening that receives a hollow drive tang of an associated ratchet wrench.

U.S. Pat. No. 845,717 Miller discloses a socket whose driven end while having a through hole does not have a sufficiently large size of the through hole so as to permit a threaded shank to be received thereby during torquing of a nut through which the threaded shank extends when considering the nominal relationship between nut and threaded shank sizes.

U.S. Pat. No. 1,447,564 Norlund et al discloses a key having a socket end including formed ribs such that the socket end can receive a specially designed grooved nut, and the key also has a polygonal end at which a wrench can be applied to torque the nut.

U.S. Pat. No. 3,532,012 Pryor discloses a chuck wrench that is utilized with a socket designed to permit adjustment of an adjusting nut of a clutch for a particular vehicle whose clutch has a threaded shaft and a jam nut associated witch the adjusting nut.

U.S. Pat. No. 3,877,328 Sullivan discloses an end wrench and socket with reducing inserts.

U.S. Pat. Nos. 4,520,697 Moetteli and 4,602,534 Moetteli disclose a socket wrench that is utilized with different size sockets whose driven ends have both female and male surfaces for being driven by an associated drive portion of the wrench which has both an external surface and an internal surface for respectively driving the sockets at the female and male drive surfaces.

U.S. Pat. No. 4,817,475 Kelly discloses a wrench socket which has a square drive opening extending through the socket but which is of too small a size to receive a threaded shank projecting through a nut driven by the socket and which is also blocked by a retaining pin so that the threaded shank could not extend therethrough even if this were possible as far as size is concerned.

DISCLOSURE OF INVENTION

One object of the present invention is to provide an improved socket and ratchet wrench combination.

In carrying out the above object, the socket and ratchet wrench combination includes a socket of a unitary construction having a central rotational axis. The socket has a driving end including internal engagement surfaces for receiving a nut to be torqued. The socket also has a driven end including a plurality of flat drive surfaces located about the rotational axis. The driven end of the socket also includes retaining grooves that extend between the adjacent drive surfaces. The driven end of the socket also has a through hole extending along the rotational axis so as to be capable of receiving a threaded shank extending through the nut being torqued. A ratchet wrench of the combination includes a head and a handle extending from the head. The head includes a drive gear supported for rotation thereon and having external drive teeth. The drive gear also includes flat drive surfaces located about the rotational axis and defining a through opening for receiving the driven end of the socket with the drive surfaces of the drive gear engaging the drive surfaces of the driven end of the socket to provide rotational driving thereof during use. The drive gear also includes retaining grooves extending along its drive surfaces. A deflectable retainer of the drive gear is received by the retaining grooves thereof and is deflected so as to be received by the retaining grooves of the driven end of the socket to detachably retain the socket to the head of the ratchet wrench for use. A reversing pawl of the ratchet wrench is mounted on the head and has teeth for engaging the drive teeth of the drive gear to provide driving and ratcheting of the socket in opposite directions that are reversible by movement of the reversing pawl.

In the socket and ratchet wrench combination, the drive surfaces of the driven end of the socket are spaced from each other about the rotational axis, and the driven end of the socket includes connecting surfaces that connect the drive surfaces thereof and have the retaining grooves formed therein so as to extend between the drive surfaces of the driven end of the socket. The construction of the socket and ratchet wrench combination also has the drive gear of the ratchet wrench provided with its drive surfaces spaced from each other about the rotational axis and also includes connecting surfaces extending between the drive surfaces thereof to cooperate therewith in defining the through opening for receiving the driven end of the socket. The drive surfaces of the drive gear as well as the connecting surfaces thereof have the retaining grooves of the drive gear formed therein to receive the deflectable retainer.

In its preferred construction, the socket and ratchet wrench combination has the retainer embodied as a split ring supported by the drive gear of the ratchet wrench. This split ring is deflectable to be received by the retaining groove in the driven end of the socket to provide the detachable securement of the socket.

In the preferred construction, the socket and ratchet wrench combination has the engagement surfaces of the driving end of the socket defining corners of a radius $R_1$ from the rotational axis and has the drive surfaces of the driven end of the socket provided with a minimum radius $R_2$ as well as having the through hole of the socket provided with a round shape with a radius $R_3$ that has a minimum size of 0.49 $R_1$ and a maximum size of 0.94 $R_2$.

The preferred construction of the socket and ratchet wrench combination also has the socket provided with an overall height $H_s$ between the driving and driven ends of the socket as well as having the drive gear of the ratchet wrench having opposite axial ends that define a height $H_h$ which is the maximum thickness of the wrench head with this maximum wrench head thickness $H_h$ being in the range of 0.2 to 0.7 of the overall height $H_s$ of the socket. Most preferably, the socket and ratchet wrench combination has the maximum wrench head thickness Hh in the range of 0.4 to 0.6 of the overall height Hs of the socket.

In the preferred construction, the socket and ratchet wrench combination has the ratchet wrench provided with its head defining a cavity that receives and rotatively supports the drive gear and that also receives and supports the reversing pawl. The wrench head also includes biaser for selectively and alternately positioning the reversing pawl to provide ratcheting in opposite directions. The wrench head also preferably includes a wall unitary with the wrench head and further includes a cover plate that is secured to the head and cooperates with the wall to position the drive gear and reversing pawl within the cavity. This wrench head cavity preferably is constructed to include overlapping circular portions of larger and smaller sizes that respectively receive the drive gear and the reversing pawl. Furthermore, the biaser is preferably constructed to include a helical compression spring and a ball biased by the spring to position the pawl.

Another object of the present invention is to provide an improves socket for torquing a nut through which a bolt shank extends.

In carrying out the above object, the socket of this invention includes a unitary socket body having a central rotational axis and including a driving end having internal engagement surfaces for receiving a nut to be torqued. These engagement surfaces define corners of a radius $R_1$ from the rotational axis. A driven end of the socket body has a plurality of drive surfaces spaced about the rotational axis with a minimum radius $R_2$. The driven end also includes retaining grooves that extend between the drive surfaces for use in detachably securing the socket to an associated wrench. The driven end of the socket has a through hole extending along the rotational axis so as to be capable of receiving a bolt shank extending through the nut being torqued. This through hole has a smallest radial dimension $R_3$ that has a minimum size of 0.49 $R_1$ and a maximum size of 0.94 $R_2$.

The preferred construction of the socket has the drive surfaces thereof spaced from each other about the rotational axis, and the driven end of the socket also includes connecting surfaces that connect the drive surfaces and have the retaining grooves formed therein so as to extend between the drive surfaces.

In its preferred construction, the through hole of the socket has a round shape whose radius is $R_3$.

The preferred construction of the socket also has the driving end provided with a height $H_{s1}$ and has the driven end provided with a height $H_{s2}$, with the driving end height $H_{s1}$ and the driven end height $H_{s2}$ being equal to the overall height $H_s$, and with the driving end height $H_{s1}$ being in the range of 0.2 to 0.7 of the overall height $H_s$. Most preferably, the driving end height $H_{s1}$ is in the range of 0.4 to 0.6 of the overall height $H_s$.

In its preferred construction, the socket also includes a plurality of stop surfaces respectively located adjacent the drive surfaces on the driven end and extend radially outward from the rotational axis.

Two different constructions of the driving end of the socket are disclosed. One has the internal engagement surfaces of the driving end defining six corners in a "six-point" construction. Another has the internal engagement surfaces of the driving end defining twelve corners in a "twelve-point" construction.

As disclosed, the driven end of the socket has four drive surfaces and four connecting surfaces that extend between the drive surfaces.

Another object of the present invention is to provide an improved ratchet wrench.

In carrying out the above object, the ratchet wrench of the invention includes a head and a handle extending from the head, with the head including a drive gear supported for rotation thereon and having external drive teeth. The drive gear also includes drive surfaces located about the rotational axis and defining a through opening for receiving a socket to be rotatively driven by the ratchet wrench. The drive surfaces of the drive gear include retaining grooves, and a retainer of the drive gear is received by the retaining grooves of the drive surfaces and is deflectable to provide detachable socket retention. A reversing pawl of the wrench is mounted on the head and has teeth for engaging the drive surfaces of the drive gear to provide rotary driving and ratcheting in opposite directions that are reversible by the movement of the reversing pawl.

In the preferred construction of the ratchet wrench, the drive gear has the drive surfaces spaced from each other about the rotational axis and also includes connecting surfaces extending between the drive surfaces to cooperate therewith in defining the through opening. The connecting surfaces of the drive gear also have retaining grooves formed therein and cooperating with the retaining grooves of the drive surfaces to define a 360° annular retaining groove that receives the deflectable retainer. This deflectable retainer is preferably constructed as a split ring received by the 360° annular retaining groove of the drive gear and is deflectable to provide the detachable socket securement.

The preferred construction of the ratchet wrench also has the drive gear provided with opposite axial ends that are spaced from each other a distance that defines the maximum thickness of the wrench head. The preferred construction of the wrench head includes a round opening that receives one axial end of the drive gear, and the wrench head defines a cavity in which the drive gear and reversing pawl .are received. The wrench head also includes a cover plate secured thereto to position the drive gear and reversing pawl within the cavity. This cover plate includes a round opening that receives the other axial end of the drive gear. A wrench head cavity preferably includes overlapping circular portions of larger and smaller sizes that respectively receive the drive gear and the reversing pawl.

In the preferred construction, the ratchet wrench also has the wrench head provided with a biaser for selectively and alternately positioning the reversing pawl to provide ratcheting in opposite directions that are reversible by movement of the reversing pawl. This biaser preferably includes a helical compression spring and a ball biased by the spring to position the reversing pawl.

In its preferred construction, the ratchet wrench also includes a reversing lever that is mounted by the reversing pawl and manually movable to reverse the direction of ratcheting provided by the reversing pawl. This reversing lever is most preferably located on the opposite side of the head from the cover plate and includes a mounting lug pressed into the pawl.

Two different constructions of the ratchet wrench are disclosed. In one construction, the ratchet wrench includes a unitary wrench body defining both the wrench head and the handle. In another construction, the ratchet wrench includes a pivotal connection that connects the wrench head and the handle to each other to provide a flex-head ratchet wrench.

The objects, features and advantages of the present invention are readily apparent from the following detailed description of the best modes for carrying out the invention when taken in connection with the accompanying drawings.

BEST MODES FOR CARRYING OUT THE INVENTION

Figure 1:
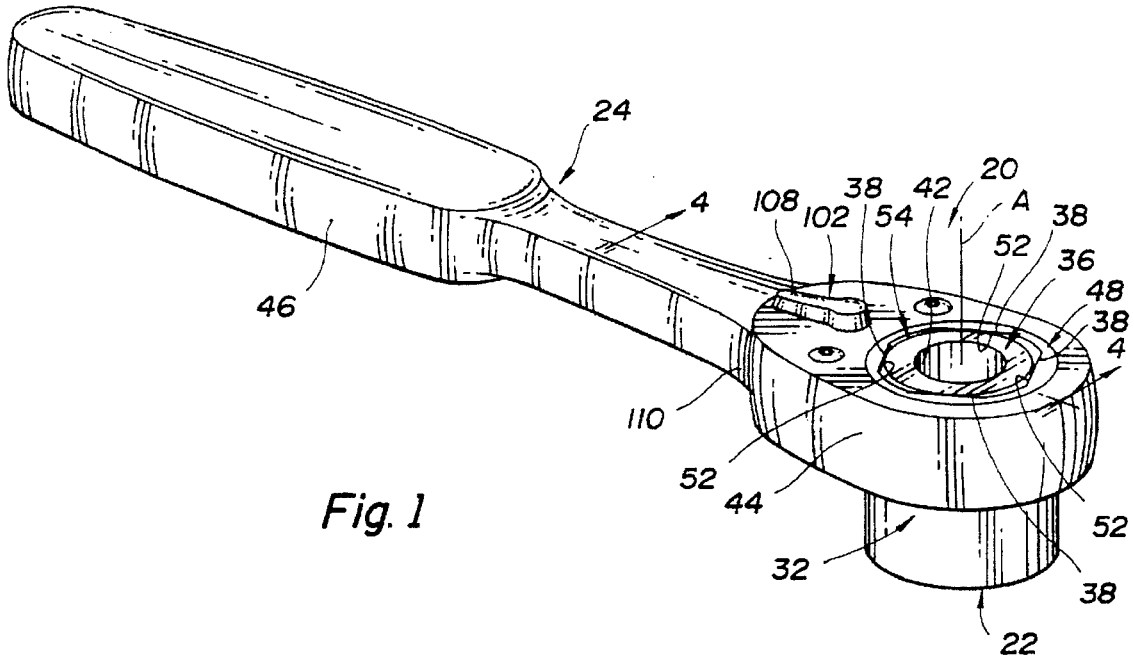
FIG. 1 is a perspective view of a socket and ratchet wrench combination that is constructed in accordance with the present invention.
Figure 4:
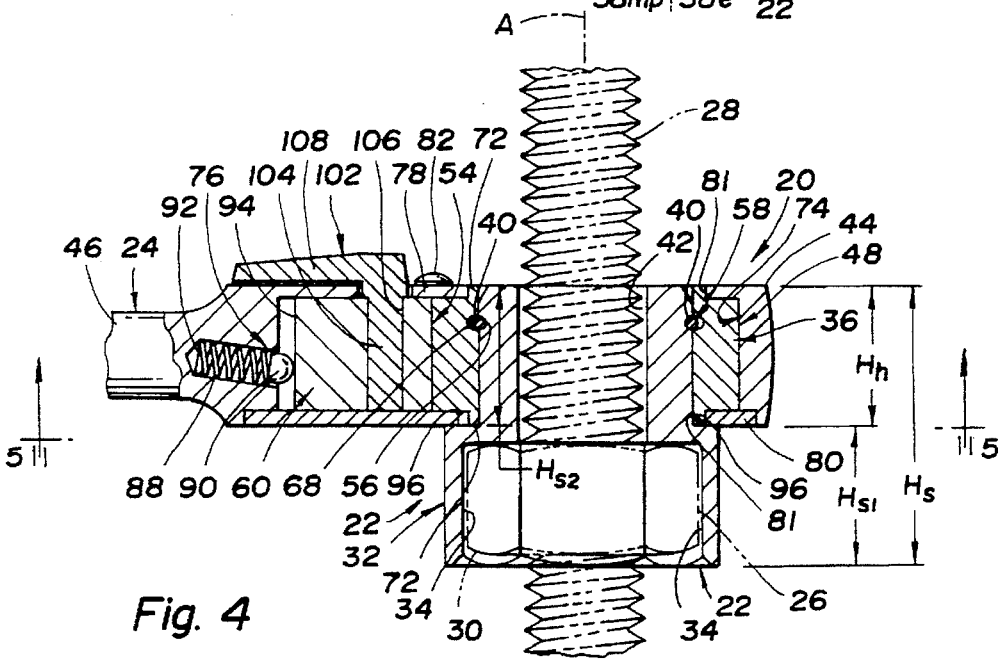
FIG. 4 is a sectional view taken along the direction of line 4—4 in FIG. 1 to illustrate the manner in which the socket permits driving of a nut through which a threaded shank extends as well as illustrating the way in which the socket is secured to the ratchet wrench.

As illustrated in FIG. 1, a socket and ratchet wrench combination is generally indicated by 20 and includes a socket 22 as well as a ratchet wrench 24 that are utilized with each other to provide the combination. During use as illustrated in FIG. 4, the ratchet wrench and socket combination 20 are capable of providing torquing of a nut 26 from which a thread shank 28 extends through both the socket 22 and wrench 24 so as to permit torquing of the nut by manual force applied at a location that is relatively close to the axial position of the nut rotation along the central axis A. It should be appreciated that the bolt shank 28 can be part of a headed bolt extending through the member 30 shown in FIG. 4 or can be part of a threaded stud that does not have any head. In ,either case, the ratchet wrench and socket combination 20 can extend over the threaded shank 28 no matter how long it needs to be projecting outwardly from the member 30 for the particular application of use.

Figure 2:
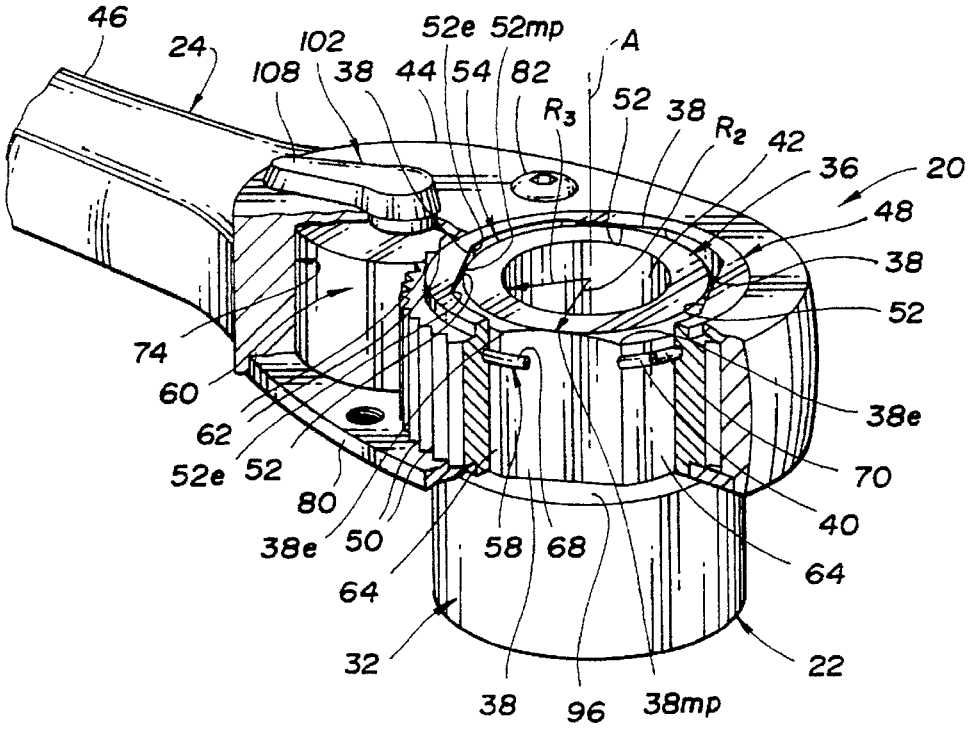
FIG. 2 is a partial partially broken away perspective view of the socket and ratchet wrench combination.

With combined reference to FIGS. 1–4 and 7, the socket 22 has a unitary construction along the central rotational axis A and includes a unitary body having a driving end 32 with internal engagement surfaces 34 (FIG. 7) for receiving the nut 26 to be torqued as shown in FIG. 4. Socket 22 also has a driven end 36 including a plurality of drive surfaces 38 located about the rotational axis. As illustrated, there are four of the drive surfaces 38 that have flat shapes spaced at 90° from each other. The driven end 36 also includes retaining grooves 40 that extend between the adjacent drive surfaces 38 and which are utilized to provide securement of the socket to the ratchet wrench 24 as is hereinafter more fully described. The driven end 36 also has a through hole 42 extending along the rotational axis A so as to be capable of receiving the threaded shank 28 extending through the nut 26 being torqued as previously described in connection with FIG. 4. As shown in FIG. 2, each flat drive surface 38 of the socket has opposite ends **38*e* and a midpoint 38*mp*** between these opposite ends.

Figure 5:
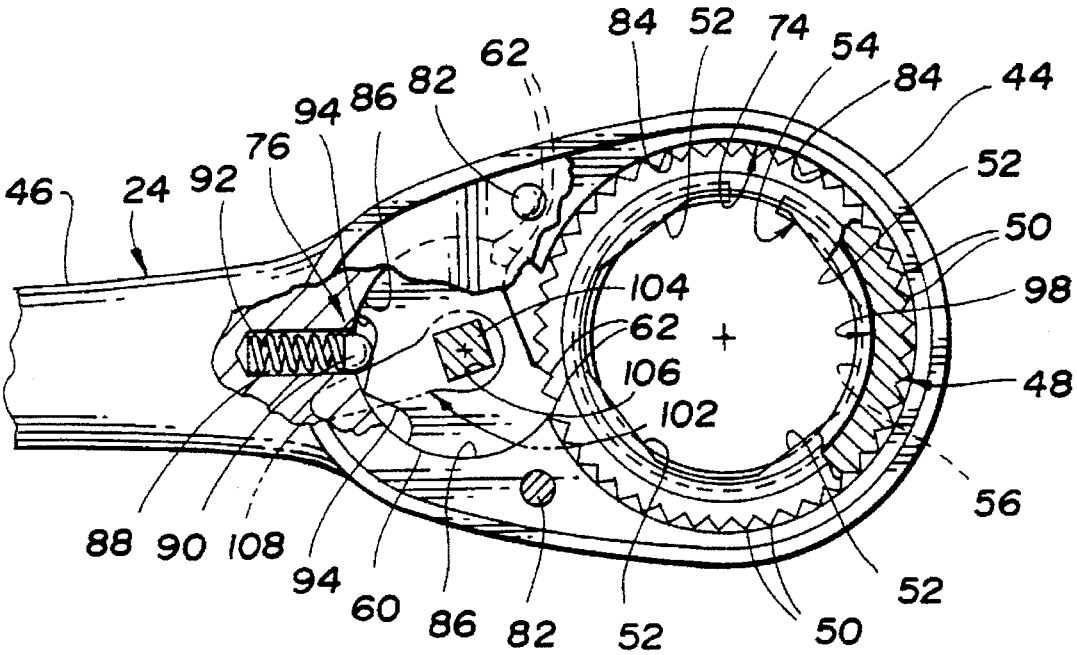
FIG. 5 is a partially broken away bottom plan view of the ratchet wrench taken along the direction of line 5—5 in FIG. 4 and illustrating a reversing pawl located so as to provide counterclockwise driving and clockwise ratcheting.

With combined reference to FIGS. 1–6, the ratchet wrench 24 includes a head 44 and a handle 46 extending from the head. The head 44 includes a drive gear 48 supported for rotation thereon and having external drive teeth 50. Drive gear 48 also includes inwardly facing drive surfaces 52, four in number and flat as illustrated in FIG. 5, located about the rotational axis A and defining a through opening 54 for receiving the driven end 36 of the socket 22 with the drive surfaces of the drive gear engaging the drive surfaces 38 of the driven end of the socket to provide rotational driving thereof as previously described. The drive gear 48 also includes retaining grooves 56 extending along the adjacent drive surfaces 52 thereof and further includes a deflectable retainer 58 received by its retaining grooves. The retainer 58 deflects so as to be received by the retaining grooves 40 of the driven end 36 of socket 22 to detachably retain the socket to the head 44 of the ratchet wrench for use. As shown in FIG. 2, each flat drive surface 52 of the drive gear has opposite ends **52*e* and a midpoint 52*mp* between these opposite ends. A reversing pawl 60 is mounted on the head 44 and has teeth 62 for engaging the drive teeth 50 of the drive gear 48 to provide driving and ratcheting of the socket in opposite directions that are reversible by movement of the reversing pawl between the positions of FIGS. 5 and 6**.

Figure 3:
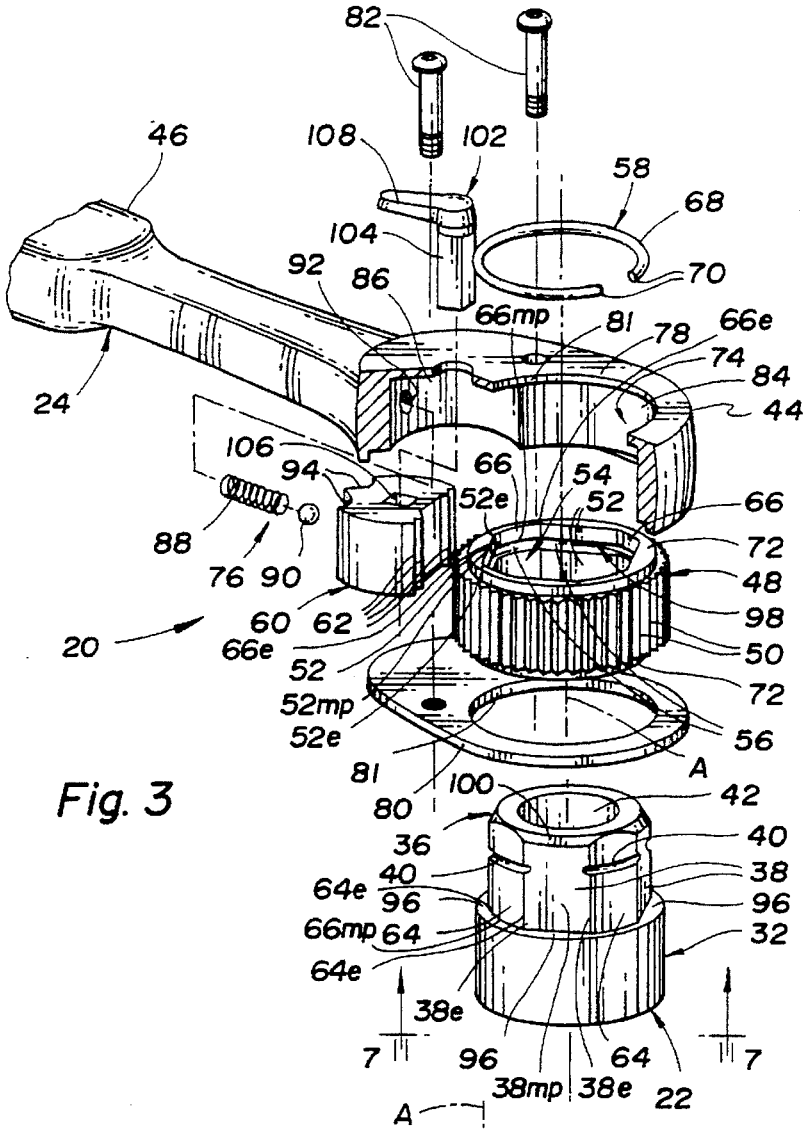
FIG. 3 is an exploded perspective view of the ratchet wrench and also illustrates one embodiment of the socket wherein the nut driving end has a larger size than the wrench driven end which is utilized with relatively large sized nuts.

In the socket and ratchet wrench combination, the flat drive surfaces 38 of the driven end 36 of socket 22 are spaced from each other about the rotational axis A and the driven end of the socket includes curved connecting surfaces 64 that connect the drive surfaces thereof as shown in FIG. 3 and have the retaining grooves 40 formed therein so as to extend between the drive surfaces. Each curved connecting surface 64 of the socket as shown in FIG. 3 has opposite ends 64*e* and a midpoint 64*mp* between these opposite ends. The midpoints 38*mp* of the flat drive surfaces 38 of the socket are located radially inward with respect to the rotational axis from the midpoints 64*mp* of the curved connecting surfaces of the socket. Likewise, the drive gear 48 of ratchet wrench 24 also has its drive surfaces 52 spaced from each other about the rotational axis A and also has connecting surfaces 66 extending between its drive surfaces to cooperate therewith in defining the through opening 54 for receiving the driven end 36 of the socket 22. Each curved connecting surface 66 of the drive gear has opposite ends 66*e* and a midpoint 66*mp* between these opposite ends. The midpoints 52*mp* of the flat drive surfaces 52 of the drive gear are located radially inward with respect to the rotational axis from the midpoints 66*mp* of the curved connection surfaces 66 of the drive gear. Both the drive surfaces 52 and the connecting surfaces 66 of the drive gear have the retaining grooves 56 formed therein to receive the deflectable retainer 58 which is preferably constructed as a split ring 68 best illustrated in FIG. 3. This split ring 63 is supported by the drive gear 48 of the ratchet wrench 24 and is deflectable to be received by the retaining grooves 40 in the driven end 36 of socket 22 to provide the detachable securement of the socket. More specifically, split ring 68 has opposite ends 70 that are located adjacent each other and movable toward and away from each other during the attachment and detachment of the socket to the ratchet wrench.

Figure 7:
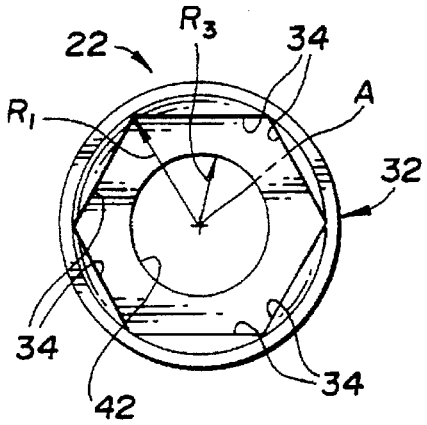
FIG. 7 is a bottom plan view of the socket taken along the direction of line 7—7 in FIG. 3 to illustrate one embodiment wherein the internal engagement surfaces that engage a nut being driven have a "six-point" construction.

As best illustrated in FIG. 7, the engagement surfaces 34 of the driving end 32 of socket 22 define corners of a radius $R_1$ from the rotational axis A. Furthermore, the drive surfaces 38 of the driven end 36 of socket 22 as shown in FIG. 2 have a minimum radius $R_2$. The through hole 42 of socket 22 preferably has a round shape with a radius $R_3$ that has a minimum size of 0.49 $R_1$ and a maximum size of 0.94 $R_2$. Such a construction provides the capability of the socket to receive a threaded shank extending from the nut being torqued while still having the requisite strength to function effectively for a prolonged lifetime of use.

As illustrated in FIG. 4, the socket 22 has an overall height $H_s$ between its driving and driven ends 32 and 36. The driving end 32 of the socket has a height $H_{si}$, while the drive gear 48 of the ratchet wrench has opposite axial ends 72 that define a height $H_h$ which is the maximum thickness of the wrench head 44 and which is equal to the height $H_{s2}$ of the driven end 36 of the socket. This maximum wrench head thickness $H_h$ preferably is in the range of 0.2 to 0.7 of the overall height $H_s$ of the socket. Most preferably, the maximum wrench head thickness $H_h$ is in the range of 0.4 to 0.6 of the overall height $H_s$ of the socket. The height $H_{si}$ of the driving end 32 of the socket is thus also in the range of 0.2 to 0.7 of the overall $H_s$ of the socket and is most preferably in the range of 0.4 to 0.6 of the overall height $H_s$.

As best illustrated in FIG. 3, the ratchet wrench 24 has its head 44 constructed to define a cavity 74 that receives and rotatably supports a drive gear 48 and also receives and supports the reversing pawl 60. Wrench head 44 also preferably includes a biaser 76 for selectively and alternately positioning the reversing pawl in either the position of FIG. 5 or the position of FIG. 6 to provide ratcheting in opposite directions. Furthermore, wrench head 44 preferably includes a wall 78 unitary with the wrench head and further includes a cover plate 80 that is secured to the wrench head in any suitable manner such as by the fasteners 82 which are illustrated as threaded bolts. Cover plate 80 cooperates with the wrench head wall 78 to position the drive gear 48 and the reversing pawl 60 within the cavity 74 as shown in FIG. 4. The construction of the wrench head cavity 74 preferably includes overlapping circular portions 84 and 86 of larger and smaller sizes that respectively receive the drive gear 48 and the reversing pawl 60. The wrench head wall 78 and cover plate 80 each have a round opening 81 that receives the adjacent round end 72 of the drive gear 48 to cooperatively provide the rotational support of the drive gear about the rotational axis A.

With combined reference to FIGS. 3–6, the biaser 76 preferably includes a helical compression spring 88 and a ball 90 biased by the spring to position the reversing pawl. More specifically, the compression spring 88 is received within a hole 92 that extends from the smaller circular portion 86 toward the wrench handle 44 and has a blind end that seats one end of the compression spring. This hole 92 as shown in FIG. 4 is most easily drilled at an angle with respect to the direction of the wrench handle so that there is no interference in the drilling by the wrench head 44. The other end of the compression spring 88 seats the ball 90 to bias the ball toward the reversing pawl 60 which has a pair of detent notches 94 on the opposite side thereof as the pawl teeth 62. Thus, positioning of the biaser ball 90 within one or the other detent notch 94 allows the ratcheting during use but also permits movement of the pawl between the positions of FIGS. 5 and 6 by deflection of the compression spring 88.

As illustrated in FIGS. 2–4, socket 22 includes a plurality of stop surfaces 96 located adjacent the drive surfaces 38 on the driven end 36 of the socket. These stop surfaces 96 extend radially outward from the rotational axis A and, as illustrated in FIG. 4, engage the wrench head 44 in the secured condition of the socket. This engagement is with the cover plate 80 that is located on the opposite side of the preferred wrench head construction from the wall 78 previously described.

As illustrated in FIG. 7, the embodiment of the socket 22 has the internal engagement surfaces 34 of the driving end 32 define six corners in a "six-point" construction.

Figure 8:
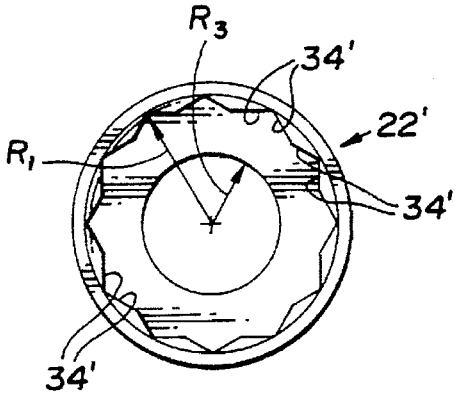
FIG. 8 is a view similar to FIG. 7 of another embodiment wherein the internal engagement surfaces that drive a nut have a "twelve-point" construction.

Another embodiment of the socket 22' illustrated in FIG. 8 has the same construction as the previously described embodiment except that its internal engagement surfaces 34' define twelve corners in a "twelve-point" construction.

Figure 9:
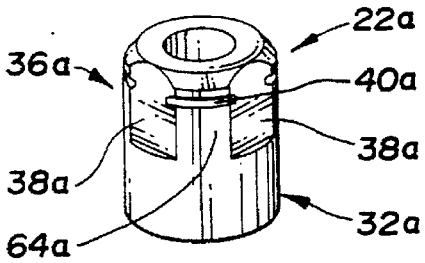
FIG. 9 is a view of another socket whose driven end has approximately the same size as the nut driving end which is desirable for intermediate sizes.

A further embodiment of the socket 22*a* illustrated in FIG. 9 is the same as the previously described embodiment except that its driving end 32*a* has approximately the same size as the driven end 36*a* unlike the embodiment of FIGS. 1–4 in which the driving end is larger than the driven end. This embodiment of the socket 22*a* is utilized to provide torquing of intermediate size nuts as compared to the embodiment of FIGS. 1–4 which is used with larger nuts. Socket 22*a* like the previously described socket 22 has its driven end 36*a* provided with four drive surfaces 38*a* and four connecting surfaces 64*a* on which the associated retaining grooves 40*a* are provided. Furthermore, socket 22*a* may have its driving end provided with a "six-point" construction as shown in FIG.. 7 or a "twelve-point" construction as shown in FIG. 8.

Figure 10:
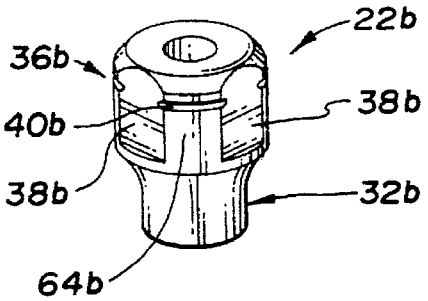
FIG. 10 is a view of another socket whose driven end has a larger size than the nut driving end which is desirable for smaller sizes.

A further embodiment of the socket 22*b* illustrated in FIG. 10 is the same as the previously described embodiments except that its driving end 32*b* has a smaller size than the driven end 36*b*. This embodiment of the socket 22*b* is utilized to provide torquing of smaller nuts as compared to the larger nuts with the embodiment of FIGS. 1–4 and intermediate size nuts with the embodiment of FIG. 10. Socket 22*a* like the previously described socket 22 has its driven end 36*b* provided with four drive surfaces 38*b* and four connecting surfaces 64*b* on which the associated retaining grooves 40*b* are provided. Likewise, socket 22*b* may have its driving end provided with either a "six-point" construction as shown in FIG. 7 or "twelve-point" construction as shown in FIG. 8.

With reference to FIGS. 4 and 5, the preferred construction of the ratchet wrench has the drive gear 48 constructed with the drive surfaces 52 and the connecting surfaces 66 extending between the drive surfaces to cooperate therewith in defining the through opening 54. The drive surfaces 52 and the connecting surfaces 66 both have the retaining grooves 56 formed therein and cooperating to define a 360° annular retaining groove 98 that receives the deflectable retainer 58 embodiment by the split ring 68. This split ring is preferably constructed from round wire and the 360° retaining groove 98 has a depth within the drive gear that is about 10% greater than the nominal wire size so that the retainer can be fully received within the drive gear during the attachment and detachment of the socket. Best results are achieved when the socket has a generally annular chamfer 100 on its driven end 36 as shown in FIG. 3 so as to facilitate the insertion and outward camming of the retainer embodied by the split ring 68 during the socket attachment.

Figure 6:
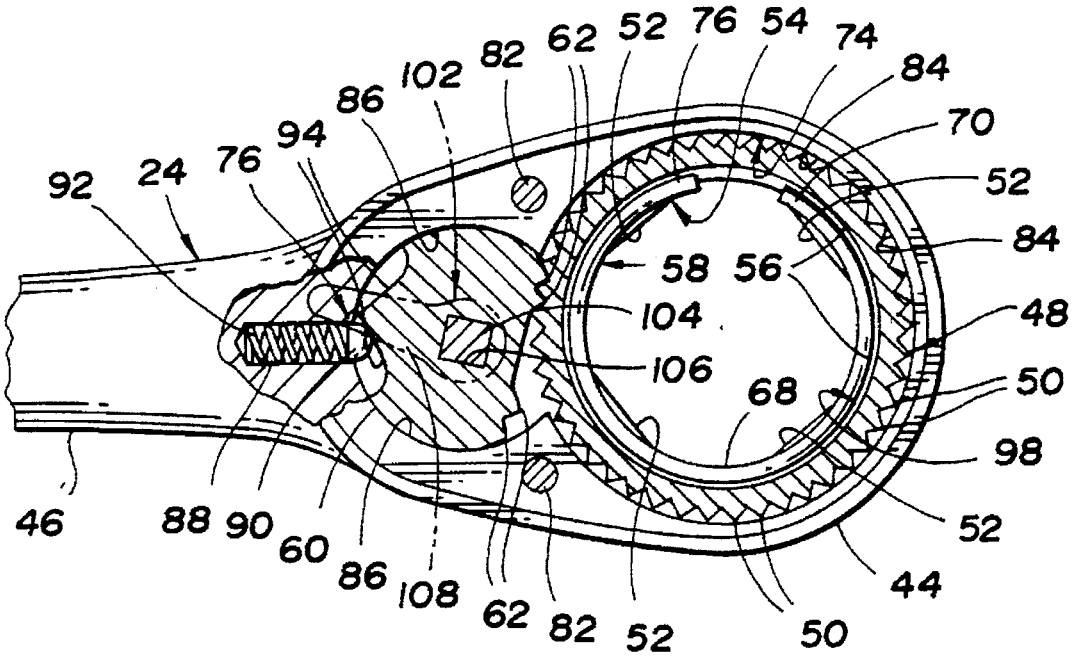
FIG. 6 is a view similar to FIG. 5 but with the reversing pawl moved so as to provide clockwise driving and counterclockwise ratcheting.

As best illustrated in FIG. 4, the ratchet wrench 24 also includes a reversing lever 102 that is mounted by the reversing pawl 60 and manually movable to reverse the direction of ratcheting provided by the reversing pawl by positioning in either the position of FIG. 5 or 6 as previously described. This reversing lever 102 includes a mounting lug 104 that is pressed into a square opening 106 (FIG. 3) in the reversing pawl during assembly. Reversing lever 102 also has a thumb tab 108 located on the opposite side of the wrench head from the cover plate 80 in an adjacent relationship to the wall 78 that is unitary with the rest of the wrench head.

Figure 11:
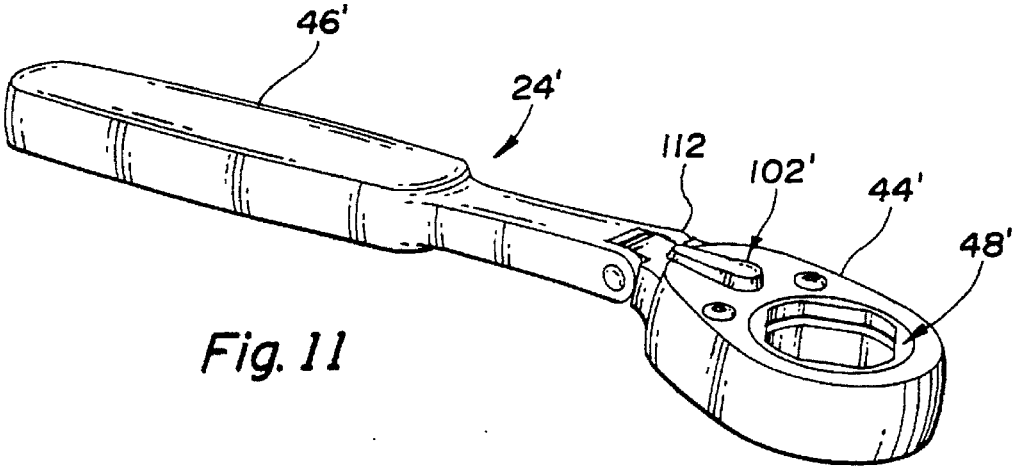
FIG. 11 is a perspective view of another embodiment of the ratchet wrench which is of the flex head type between the wrench head and handle unlike the embodiment of FIGS. 1–6 wherein the wrench head and handle are unitary with each other.

While the embodiment of the ratchet wrench 24 illustrated in FIGS. 1–6 includes a unitary wrench body 110 defining both the wrench head 44 and the handle 46, another embodiment of the ratchet wrench 24' illustrated in FIG. 11 has the same construction as the previously described embodiment but includes a pivotal connection 112 that connects the wrench head 44' and the handle 46' to provide a flex-head ratchet wrench.

While the best modes for carrying out the invention have been described in detail, those familiar with the art to which this invention relates will recognize various alternative constructions and designs for carrying out the invention as described by the following claims.

What is claimed is:

1. A socket and ratchet wrench combination, comprising:

a socket of a unitary construction having a central rotational axis, the socket having a driving end including internal engagement surfaces for receiving a nut to be torqued, the socket also having a driven end including a plurality of flat drive surfaces located about the rotational axis in a spaced relationship to each other, each flat drive surface of the socket having opposite ends and a midpoint therebetween, the driven end also including curved connecting surfaces that connect the flat drive surfaces, each curved connecting surface of the socket having opposite ends and a midpoint therebetween, the midpoints of the flat drive surfaces of the socket being located radially inward with respect to the rotational axis from the midpoints of the curved connecting surfaces of the socket, the curved connecting surfaces including retaining grooves that extend between the adjacent flat drive surfaces, and the driven end having a through hole extending along the rotational axis so as to be capable of receiving a threaded shank extending through the nut being torqued; and a ratchet wrench including a head and a handle extending from the head, said head including a drive gear supported for rotation thereon and having external drive teeth, the drive gear including inwardly facing flat drive surfaces located about the rotational axis in a spaced relationship to each other and the drive gear also including curved connecting surfaces that connect the flat drive surfaces thereof, the flat drive surfaces and connecting surfaces of the drive gear cooperatively defining a through opening for receiving the driven end of the socket with the flat drive surfaces of the drive gear engaging the flat drive surfaces of the driven end of the socket to provide rotational driving thereof, the flat drive surfaces and curved connecting surfaces of the drive gear each having opposite ends and a midpoint therebetween, the midpoints of the flat drive surfaces of drive gear being located radially inward with respect to the rotational axis from the midpoints of the curved connecting surfaces of the drive gear, the drive gear including retaining grooves extending along the flat drive surfaces and connecting surfaces thereof, the drive gear including a deflectable retainer received by the retaining grooves in the flat drive surfaces and connecting surfaces thereof, the retainer deflecting to be received by the retaining grooves in the connecting surfaces of the driven end of the socket to detachably retain the socket to the head of the ratchet wrench for use, and a reversing pawl mounted on the head and having teeth for engaging the drive teeth of the drive gear to provide driving and ratcheting of the socket in opposite directions that are reversible by movement of the reversing pawl.

2. The socket and ratchet wrench combination of claim 1 wherein the retainer comprises a split ring supported by the drive gear of the ratchet wrench, and the split ring being deflectable to be received by the retaining grooves in the driven end of the socket to provide the detachable securement of the socket.

3. The socket and ratchet wrench combination of claim 1 wherein the engagement surfaces of the driving end of the socket define corners of a radius $R_1$ from the rotational axis, the drive surfaces of the driven end of the socket have a minimum radius $R_2$, and the through hole of the socket having a round shape with a radius $R_3$ that has a minimum size of 0.49 $R_1$ and a maximum size of 0.94 $R_2$.

4. The socket and ratchet wrench combination of claim 1 wherein the socket has an overall height $H_s$ between the driving and driven ends thereof, the drive gear of the ratchet wrench having opposite axial ends that define a height $H_h$ which is the maximum thickness of the wrench head, and the maximum wrench head thickness $H_h$ being in the range of 0.2 to 0.7 of the overall height $H_s$ of the socket.

5. The socket and ratchet wrench combination of claim 4 wherein the maximum wrench head thickness $H_h$ is in the range of 0.4 to 0.6 of the overall height $H_s$ of the socket.

6. The socket and ratchet wrench combination of claim 1 wherein the ratchet wrench has its head defining a cavity that receives and rotatably supports the drive gear and that also receives and supports the reversing pawl, the wrench head including a biaser for selectively and alternately positioning the reversing pawl to provide ratcheting in opposite directions, and the wrench head including a wall unitary with the wrench head and also including a cover plate that is secured to the wrench head to cooperate with the wall to position the drive gear and reversing pawl within the cavity.

7. The socket and ratchet wrench combination of claim 6 wherein the wrench head cavity includes overlapping circular portions of larger and smaller sizes that respectively receive the drive gear and the reversing pawl.

8. The socket and ratchet wrench combination of claim 6 wherein the biaser includes a helical compression spring and a pawl biased by the compression spring to position the reversing pawl.

9. A socket and ratchet wrench combination, comprising:

a socket of a unitary construction having a central rotational axis, the socket having a driving end including internal engagement surfaces for receiving a nut to be torqued, the socket also having a driven end having a plurality of flat drive surfaces spaced from each other about the rotational axis, each flat drive surface of the socket having opposite ends and a midpoint therebetween, the driven end including curved connecting surfaces that connect the flat drive surfaces, each curved connecting surface of the socket having opposite ends and a midpoint therebetween, the midpoints of the flat drive surfaces of the socket being located radially inward with respect to the rotational axis from the midpoints of the curved connecting surfaces of the socket, the curved connecting surfaces including retaining grooves, and the driven end having a through hole of a round shape extending along the rotational axis so as to be capable of receiving a threaded shank extending through the nut being torqued; and a ratchet wrench including a head and a handle extending from the head, said head including a drive gear supported for rotation thereon and having external drive teeth, the drive gear including inwardly facing spaced drive surfaces that are flat and the drive gear also including curved connecting surfaces extending between the flat drive surfaces to cooperate therewith in defining a through opening for receiving the driven end of the socket with the flat drive surfaces of the drive gear engaging the flat drive surfaces of the driven end of the socket to provide rotational driving thereof, the flat drive surfaces and curved connecting surfaces of the drive gear each having opposite ends and a midpoint therebetween, the midpoints of the flat drive surfaces of drive gear being located radially inward with respect to the rotational axis from the midpoints of the curved connecting surfaces of the drive gear, the flat drive surfaces and connecting surfaces of the drive gear including retaining grooves, the drive gear including a split retaining ring received by the retaining grooves of the drive surfaces and connecting surfaces thereof, the retaining ring deflecting to be received by the retaining grooves in the connecting surfaces of the driven end of the socket to detachably retain the socket to the head of the ratchet wrench for use, and a reversing pawl mounted on the head and having teeth for engaging the drive teeth of the drive gear to provide driving and ratcheting of the socket in opposite directions that are reversible by movement of the reversing pawl.

* * * * *